United States Patent [19]

McGee et al.

[11] 4,181,175

[45] Jan. 1, 1980

[54] CONTROL LINE EXITING COUPLING

[75] Inventors: John K. McGee; Charles D. Bridges, both of Houston, Tex.; Robert T. Brown, Glasgow, Scotland

[73] Assignee: Combustion Engineering, Inc., Windsor, Conn.

[21] Appl. No.: 946,137

[22] Filed: Sep. 27, 1978

[51] Int. Cl.[2] ..... E21B 33/03

[52] U.S. Cl. ..... 166/85; 166/88; 285/357

[58] Field of Search ..... 166/88, 89, 85; 285/137 A, 137 K, 196, 356, 357

[56] References Cited

U.S. PATENT DOCUMENTS

| | | | |
|---|---|---|---|
| 2,485,497 | 10/1949 | Lemley et al. | 166/88 |
| 2,889,886 | 6/1959 | Gould | 166/89 |
| 3,043,371 | 7/1962 | Rector | 166/88 |
| 3,072,142 | 1/1963 | Yancey | 166/95 |
| 3,080,180 | 3/1963 | Rector | 166/89 |
| 3,739,846 | 6/1973 | Beson | 166/89 |
| 3,741,297 | 6/1973 | Drouin | 166/89 |
| 3,806,168 | 4/1974 | McGee et al. | 166/89 |
| 3,814,179 | 6/1974 | Hull, Jr. | 166/89 |
| 3,965,977 | 6/1976 | Beson | 166/88 |

*Primary Examiner*—James A. Leppink
*Attorney, Agent, or Firm*—Cushman, Darby & Cushman

[57] ABSTRACT

The control line exiting coupling provides radial penetration of a controlline through a tubing hanger wall, with a back seat for sealing should internal pressure create a packing leak on the penetrator. The back seat further prevents withdrawal of the device through the packing and provides for withdrawing the control line tubing so the hanger may be removed from the wellhead without shearing off the control line tubing.

7 Claims, 3 Drawing Figures

CONTROL LINE EXITING COUPLING

BACKGROUND OF THE INVENTION

Often, there is a need to provide a petroleum well with a down hole pump, valve and/or other sensing or control devices with an electrical or fluid pressure conduit to the surface. Fittings have been developed for use at the place where such conduits pass through the wellhead.

During a study performed in connection with the development of the present invention, the following prior publications relating to other efforts in this field have come to light.

UNITED STATES PATENTS

| Patentee | U.S. Pat. No. | Issue Date |
|---|---|---|
| Jones | 2,042,229 | May, 1936 |
| Martinson | 2,689,611 | September, 1954 |
| Rector | 3,043,371 | July, 1962 |
| Williams | 3,306,358 | February, 1967 |
| Beson | 3,739,846 | June 19, 1973 |
| Beson | 3,965,977 | June 29, 1976 |

DRAWING

E-5981 GRAY WELLHEAD ASSEMBLIES $8\frac{5}{8}\times2\frac{3}{8}\times1\frac{3}{8}$ "WD" DUAL ARR. FOR OTIS SAFETY VALVE prepared at Gray Tool Company, Houston, Tex., May 7, 1961 for presentation in May, 1961 to prospective customers Phillips Petroleum and Signal Oil in Maracaibo, Venezuela.

SUMMARY OF THE INVENTION

The control line exiting coupling provides radial penetration of a control line through a tubing hanger wall, with a back seat for sealing should internal pressure create a packing leak on the penetrator. The back seat further prevents withdrawal of the device through the packing and provides for withdrawing the control line tubing so the hanger may be removed from the wellhead without shearing off the control line tubing.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENT

Figure 1:
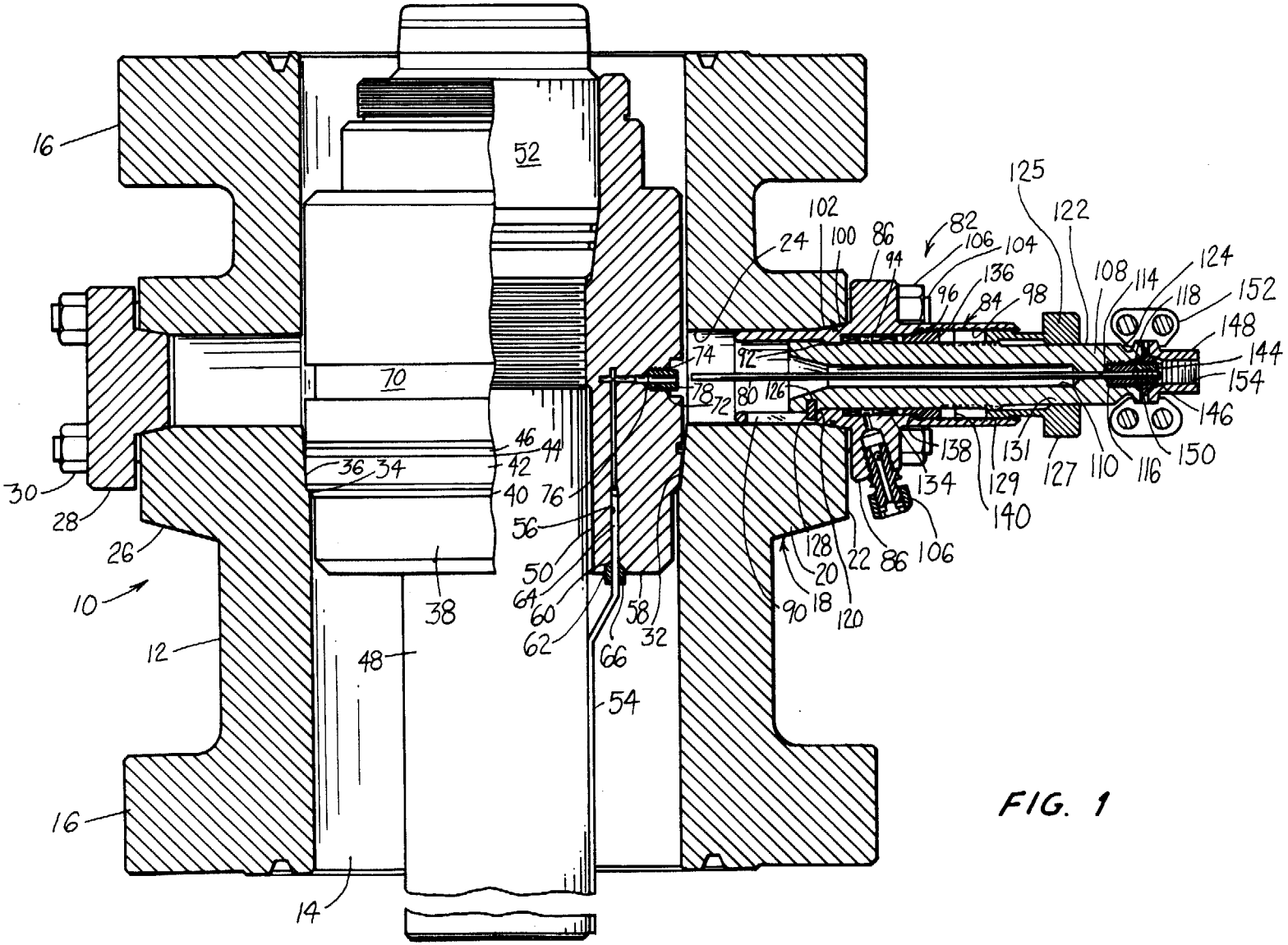
FIG. 1 is a longitudinal sectional view of a partly assembled wellhead provided with the apparatus of the invention, the control line tubing being shown in its retracted position.

In the drawings, item 10 is an intermediate portion of a wellhead; in this instance a tubing head. In some wells, a unitary enclosure is provided for casing hangers and tubing hangers, in other, the various hangers are mounted and sealed in individual casing and tubing heads stacked upon one another and secured together. For completion, the unitary head, or upper most tubing head 10 generally is topped by a bonnet carrying a christmas tree, or other production tubing flow control devices. During the lifetime of a petroleum well, generally there is a need to partially disassemble the wellhead at least once. Such disassembly may be needed for repair work, for removal of obstructions, renewal of packings, conversion to artificial lift production, and the like.

The tubing head 10 is generally a vertically-oriented tubular body 12, with a longitudinal throughbore 14 and circumferential flanges 16 at each end. The flanges 16 permit the tubing head 10 to be bolted or otherwise secured and sealed with other wellhead parts in a conventional manner.

Intermediate its end flanges 16, the head 10 is provided with a side outlet 18, shown in the form of an external annular boss 20 with a flat outer end 22. A radial bore 24 extends through the boss 20 from the end 22 and intersects with the tubing head throughbore 14.

A similar side outlet 26 is shown provided at a diametrically opposite location, and is closed and sealed by a blanking hub 28 that is shown bolted in place at 30.

Below the intersection of the bore 24 therewith, the throughbore 14 is shown provided with a circumferentially extending, upwardly facing, coaxially annular seat 32. In this instance, the seat 32 is shown having a lower, less steeply tapered portion 34 and an upper, more steeply tapered portion 36.

A tubing hanger 38 is shown received in the throughbore 14 with its external downwardly facing shoulders 40, 42 which are complementary, respectively, to the seat portions 34 and 36, engaging those seat portions and thereby supporting the tubing hanger in the wellhead.

In general, upon further completion of the well various conventional sealing and hold-down means would be installed above the tubing hanger. The exterior of the tubing hanger 38 is shown coaxially provided, intermediate the radial and axial extent of the shoulder 42, with a groove 44, in which a sealing ring 46 is provided for sealing between the exterior of the tubing hanger 38 and the throughbore 14 below the side outlets 18, 26.

A string of tubing 48 is shown conventionally hung in the throughbore 50 of the tubing hanger 38 via an enlarged, double-tapered individual tubing hanger 52. In practice, the individual tubing hanger 52 is held down and sealed from above by other conventional wellhead parts (not shown).

(In a side-by-side multiple completion, the tubing hanger 38 would have two or more side-by-side throughbores 50, each having a tubing string 48 hung therein via a respective individual tubing hanger 52. Especially in such an instance, the side outlet 26 could be provided with a control line penetrator like the one about to be described in relation to the side outlet 18, for operating down hole equipment pertaining to one or more of the production zones, or the like.)

Let us now postulate that down in the well which is surmounted by the wellhead 10, there is a pump, valve, sensor, control or control device (not shown), hereinafter a "down hole device," which communicates with the surface, externally of the wellhead, via pressure changes in hydraulic fluid, air, water or the like, hereinafter a "communicating medium." (Although presently less likely, it is possible the communicating medium could be a flow of electrons along a wire, a flow of photons along a light transmitting fiber, a flow of electromagnetic radiation through a wave guide, or the like.)

In any case, as the well is completed, and the down hole device (not shown) is run into the well and stationed down hole, a string of conduit 54 for communicating medium is operatively secured thereto. It extends upwards to a passageway 56 which intersects at one end with the axially lower end 58 of the tubing hanger 38. At that intersection, the passageway 56 is counterbored at 60 and threaded at 62. The upper end portion 64 of the communicating medium conduit 54 sockets into the counterbore 60 and is sealingly secured in place by a threaded, tubular fitting 66.

The passageway 56 proceeds part way up the interior of the hanger 38, then turns radially outwards and exits from the hanger 38 at 68, intermediate the axial extent of the hanger 38. At that level, the hanger 38 is coaxially provided with a circumferentially extending, radially outwardly opening, axially extensive groove 70. Between where the passageway 56 turns radially outwards, and the groove 70, the radially outer portion of the passageway 56 is counterbored at 72 and internally threaded at 74. This counterbore and threaded portion receive a standard ferrule and nut 76, 78.

After the string of tubing 48, and the control line 54 are run into the well and the tubing hanger 38 and individual hanger 52 are hung in place, as shown, the groove 70 is at the level of the side outlet 18 and the ferrule and nut 76, 78 are generally coaxial with the radial bore 24. Then, a length 80 of fairly flexible metal tubing, such as is commonly used for hydraulic lines, is inserted in the bore of the ferrule 76 and nut 78 (FIG. 3), and a conventional tool is inserted through the radial bore 24 and manipulated to tighten the nut 78 thus squeezing the ferrule 76 against the exterior of the length of tubing 80. This makes a frictional, sealed connection of the inner end of the tubing 80 in the tubing hanger 38.

It should be noticed that this relatively flexible length of tubing 80 is the only element which crosses the interface between the throughbore of the head 10 and the O.D. of the hanger 38, and that at this crossing point, the circumferential groove 70 and nut 78 provide some spacing radially between the I.D. of the head 10 and the O.D. of the hanger 38.

The apparatus of the preferred embodiment of the invention further provides a control line exiting coupling radial penetrator assembly 82.

The assembly 82 is shown including a tubular housing 84 having a circumferentially extending radial flange 86 provided on the exterior thereof intermediate the inner and outer ends thereof. Noteworthy features in the throughbore 88 thereof include, from the inner end, an axially elongated, angularly narrow slot 90, an inwardly facing coaxially frusto-conical back seat 92 and, axially spaced therefrom, a radially enlarged packing-receiving annulus 94, a coaxially annular axially outwardly facing packing retainer stop shoulder 96, and an internally threaded band 98 extending to the other end of the throughbore 88. Noteworthy external features of the housing 84, in addition to the flange 86, include a coaxially annular, axially inwardly facing frusto-conical band 100 located axially between the flange 86 and the slot 90. A complementarily tapered seat 102 is coaxially formed internally in the radial bore 24 at the outer end thereof. The flange 86 is coaxially provided with a circle of bolt holes (not shown), through which studs 104 of the side outlet are received. Nuts 106 threaded on these studs secure the assembly 82 in place with the axially inner tubular portion thereof fitted in the radial bore 24 and a metal-to-metal seal is thus formed at 100, 102.

The tubular housing 84 is shown further provided with a conventional valved injection port 106 for plastic sealant, communicating through the flange 86 with an intermediate site in the packing-receiving annulus 94.

Prior to being installed, the tubular housing 84 is assembled with other parts to make up the assembly 82. These include an elongated tubular actuator sleeve 108. This part is shown having a throughbore 110 having a coaxially inwardly facing frusto-conical guide surface 112 at its inner end and, near its outer end, a constricted portion 114 of almost-as-small a diameter as the O.D. of the control line tubing 80. Axially beyond the constriction, the bore 110 includes a coaxial, axially outwardly opening annular socket 116 and a frusto-conical seat 118, e.g. for a Grayloc sealing ring.

Exteriorly, the sleeve 108 is coaxially provided near its inner end with an axially outwardly facing frusto-conical sealing surface 120 and near its outer end with a band 122 of external threading. Axially beyond the threading 122, the sleeve 108 is provided with means for connecting piping thereto. This means is shown comprising a groove 124 e.g. for a Grayloc clamp. Between its axially inner end and the sealing surface 120, the sleeve 108 is shown provided with a radially extending, internally threaded bore 126.

Figure 3:
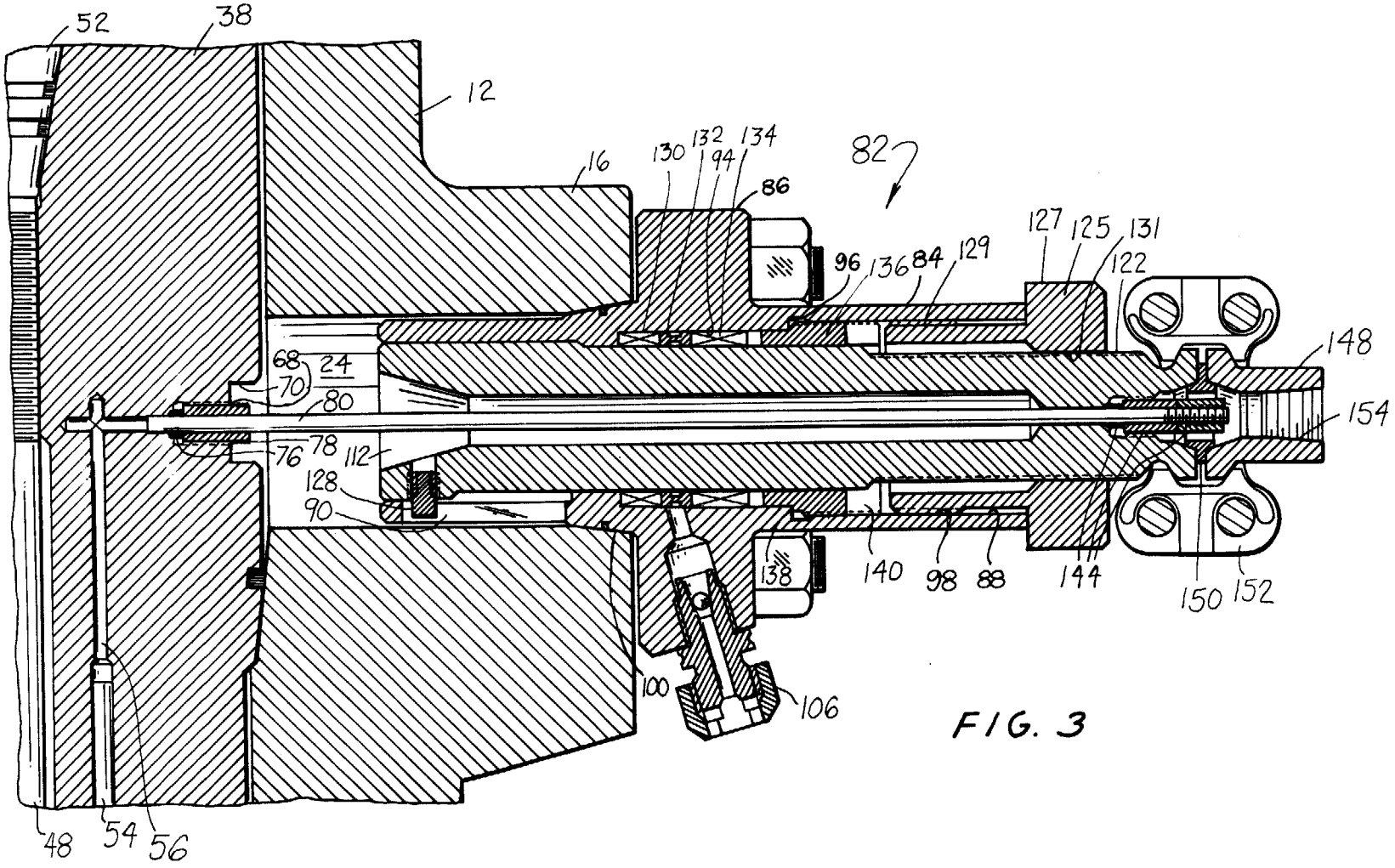
FIG. 3 is a fragmentary longitudinal sectional view similar to FIG. 1, but on a larger scale, the control line tubing being shown in its extended position.

For assembly, the axially outer end of the sleeve 108 is slid into the bore of the housing 84 and these two parts are telescoped to the relative positions shown in FIG. 3. An annular nut 125 with an external wrenching flange 127, and bands of both external and internal threading 129, 131, is threaded onto the sleeve and into the housing bore from their outer ends as shown. A threaded stud 128 is then threaded into the bore 126 through the slot 90 and is left protruding into the slot 90 so that the stud and slot 128, 90 respectively provide a key and keyway which coast to both prevent rotation of the sleeve 108 relative to the housing 84 and to limit axial travel of the sleeve 108 relative to the housing 84.

Into the axially outwardly open annulus between the actuator sleeve 108 and housing 84 are serially inserted a first packing annulus 130, a lantern ring 132, a second packing annulus 134 and an externally threaded packing retainer ring 136 which is coaxially provided with an axially inwardly facing stop shoulder 138 for preventing excessive compression of the packing. The retainer is threadably engaged with the internal threaded band of the housing 84 bore and is rotated via its wrenching lugs 140, until the stop shoulder 138 abuts the stop shoulder of the housing bore.

(The packing is of a conventional type. It is not intentionally any smaller in O.D. than the I.D. of the packing receiving annulus. Thus there is no planned spill-over of the packing upon the O.D. of the lantern ring or retainer upon tightening of the retainer. The packing normally is fully energized by axial compression, upon tightening the retainer. The injection port, preferably, is used for injection of plastic sealant only in case tightening of the retainer insufficiently radially expands the packing to make a good seal. This also is a conventional procedure.)

In general, this completes the assembly 82.

For installation of the assembly 82, after the length of control line tubing 80 is already installed through the side outlet and frictionally secured in place by tightening the nut 78 to axially squeeze and thus radially expand the ferrule 76, the assembly is slipped over the outer end of the tubing 80 and telescoped therewith until the relative positions shown in FIG. 3 are reached. The nuts 106 are then threaded on the studs 104, securing the assembly in place and making up the metal-to-metal seal at 100, 102.

A singular nut and seal assembly 144, including a ferrule and nut is then installed in the annulus between the tubing 80 and actuator sleeve 108 at their outer ends. The assembly 144 includes both external threading which mates with the band of the internal threading in the actuator sleeve 108 and internal threading which mates with a band of external threading 146 on the tubing 80, thus securing the outer end of the tubing 80 to the actuator sleeve 108 axially outwardly of the shoulder 117 of the socket 116.

Installation on the outer end of the actuator sleeve 108 of a flanged tubular hub 148, e.g. a Grayloc hub, with a sealing ring 150, e.g. a Grayloc sealing ring interposed, is shown accomplished using a securement means 152, e.g. a Grayloc clamp.

("Grayloc" is a registered trademark of Combustion Engineering, Inc., Windsor, Conn., U.S.A., for a line of sealing, connecting and fluid containment products of its Gray Tool Company division, of Houston, Tex., U.S.A.) Often, it is anticipated the assembly 82 would be factory-supplied with the hub 148, ring 150, and clamp 152 already connected therewith for convenience of field connection of the assembly 82 to an external continuating (not shown) of the control line means.

The hub 148 has means, e.g. threading 154 at its outer end, permitting connection of an external continuation (not shown) of control line means for operating the down hole device (not shown), via the pathway which extends up from that device, through the control line conduit 54, the passageway 56 in the tubing hanger 38, through the length of control line 80 of the penetrator 82 and through the hub 148 to the external continuation (not shown) of the control line means. The latter of course will connect with whatever it is desired that the down hole device (not shown) communicate with, e.g. a control panel, a pump, instrumentation, etc., for operating, controlling, and/or obtaining feedback from the down hole device.

Figure 2:
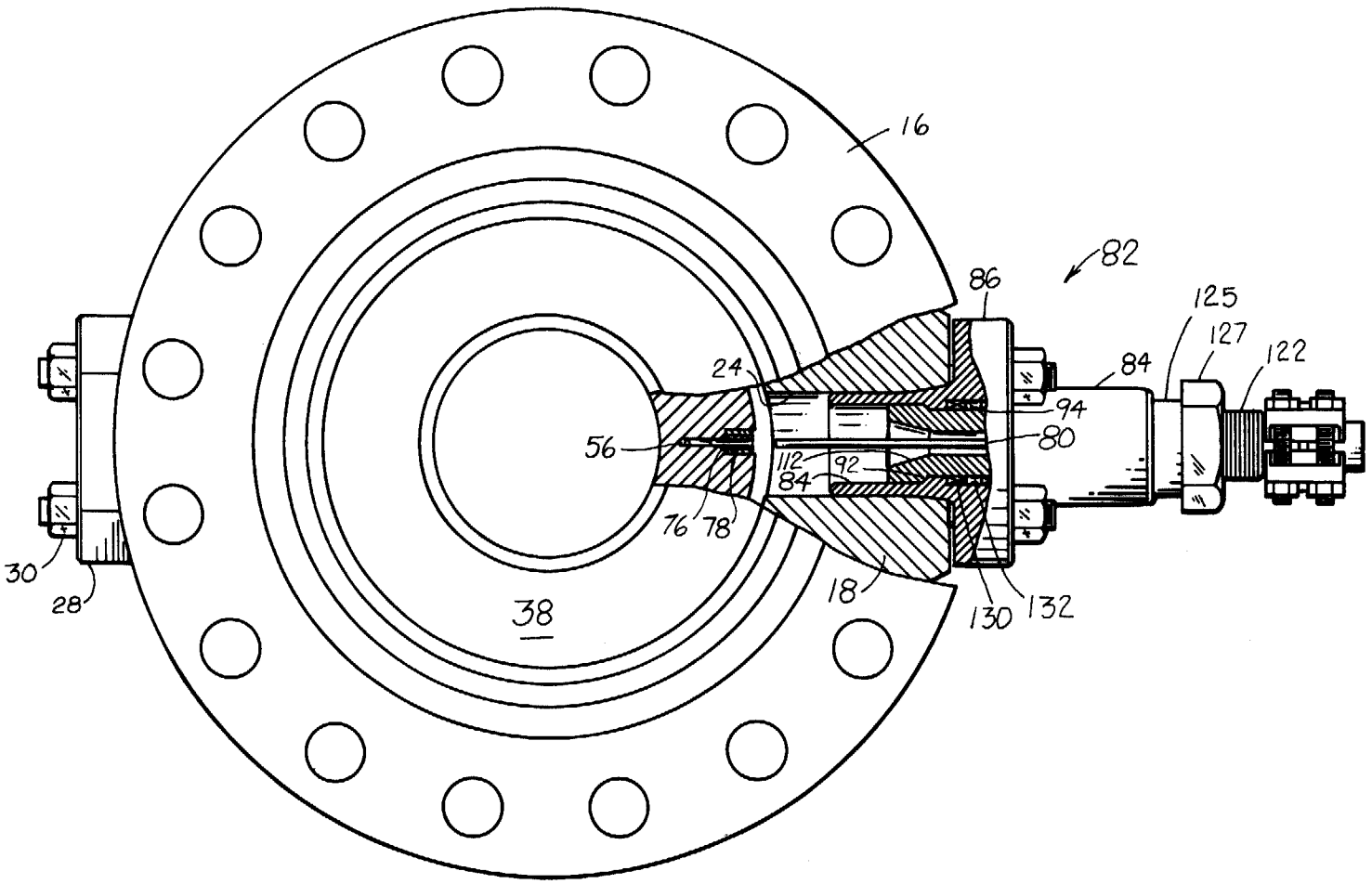
FIG. 2 is a top plan view of the apparatus of FIG. 1, with a portion broken away and sectioned to expose interior details.

It is anticipated that once an installation, as just described, has been made and is in operation, a long period of time, e.g. years, may pass before there is a need to disturb the installation. In short, it may continue operation as shown in FIG. 3 for an indeterminate period of time without assuming the condition shown in FIGS. 1 and 2.

However, if and when the time comes, e.g. during a workover procedure, when there is a need to withdraw the tubing hanger 38 from the well, the apparatus of the invention provides a convenient safe way for containing subterranean pressure and for disconnecting the length of tubing 80 without shearing it off.

Simply, the nut 125 is turned via its external wrenching flange, in a sense to back the nut out of the throughbore of the housing 84. Because the nut is also threaded to the actuator sleeve 108 and the actuator sleeve 108 is keyed against rotation, and further because the frictional connection of the inner end of the control line tubing section 80 is less tenacious than the frictional and threaded connection of the outer end of the control line tubing section 80 to the actuator sleeve, threading out the nut 125 axially outwardly withdraws the actuator sleeve 108, which pulls the control line tubing section 80 outwards, to the disposition shown in FIGS. 1 and 2. In this withdrawn position, the inner end of the control line tubing section lies radially outwardly, beyond the tubing hanger/tubing head interface, and a metal-to-metal back seat is made up at 92, 120, thus preventing leakage of subterranean pressure between the housing 84 and the actuator sleeve 108. Now, the tubing hanger may be withdrawn from the well.

When the wellhead is reassembled, the control line tubing section 80 may be inserted in the tubing hanger socket to reestablish the integrity of the control line.

The use of the length of metal tubing 80 to complete the primary fluid passage from outside the wellhead to the control line 54 within the well is of great importance to the present invention.

It is important that there is provided positive sealing and attaching of the tubing 80 to the hanger 38 at 78 and that this is accomplished independently of the rest of the device. Also important is the completion of positive sealing at 144 where the tubing 80 exits from the coupling and the mechanical gripping at this site, which provides for withdrawal of the tubing 80 from the connection at 78 and across the interface 38/12 when the nut 125 is rotated.

The way in which the tubing 80 is coupled at both ends allows the tubing itself to accommodate a wide range of radial and axial misalignment between the tubing hanger 38 and the tubing head 12, and makes it unnecessary to precut the tubing 80 to an exact length. This also makes field installation extremely easy. It is preferred that upon installation, the tubing 80 purposely be left in the condition of being flexed; the tubing 80 is capable of absorbing a wide range of stresses imposed on it by differential movement between the hanger 38 and head 12 such as results from mechanical movement of the parts or from thermally induced stresses.

It should now be apparent that the control line exiting coupling as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A wellhead sidewall penetrator system for providing a disconnectable intermediate portion of a fluid-tight passageway for a communicating medium, between a down hole device within a well, and a control point externally of the well which, in use, are connected by the fluid-tight passageway, for in an instance in which the wellhead will include a generally upright, tubular-sidewalled head portion having an axial throughbore with an upwardly facing seat therein, and a side outlet comprising a radial bore which intersects said throughbore intermediate the ends of said throughbore, and which emerges through the tubular sidewall intermediate the ends of said tubular sidewall; and will include a pipe hanger hung in the wellhead via said seat; and for an instance in which the fluid-tight passageway will extend axially up through the hanger to an intermediate level of said hanger, then extend laterally outwards, emerging from the hanger at a mouth disposed intermediate the axial extent of the hanger, in an exteriorly radially recessed region of said hanger, said wellhead penetrator system comprising:

a length of control line tubing having an inner end and an outer end;

a sealing and connector means in said mouth of said fluid-tight passageway;

the inner end of said length of control line tubing normally being disposed radially inwardly beyond an imaginary interface radially between the throughbore of the tubular sidewalled-head portion and the pipe hanger by an interfacial penetration distance, and there being disposed in said mouth of said fluid-tight passageway and normally being sealed and connected in said mouth as an intermediate continuation of said fluid-tight passageway, but being axially withdrawable from said mouth upon the application of an axial withdrawing force on said length of control line tubing, without there being a need for fully circumferentially rotating said length of control line tubing relative to its own longitudinal axis;

a tubular housing with a throughbore;

means for sealing and securing the tubular housing to the wellhead tubular head portion at the side outlet with the throughbore of the tubular housing united with the radial bore of the side outlet;

an actuator sleeve telescopically received in the throughbore of the tubular housing;

key and keyway means provided on and engaging between said tubular housing and said actuator sleeve, for preventing the actuator sleeve from fully circumferentially rotating about the longitudinal axis thereof;

a first band of differential helical threading on said tubular housing and a second band thereof on said actuator sleeve;

actuator sleeve axial position-controlling nut means threadably engaging with both said bands of differential helical threading and normally being so engaged over a sufficient length as to cause axially outward travel of the actuator sleeve, relative to the tubular housing upon rotation of said nut means in one angular sense, by an axial amount at least as long as said interfacial penetration distance;

means providing a longitudinal bore in said actuator sleeve, opening at the radially inner end of the actuator sleeve;

said length of control line tubing, when the tubular housing is sealed and secured to the wellhead tubular head portion, extending radially outwardly relative to said wellhead tubular head portion, and axially telescopically within the axial bore of said actuator sleeve;

means on said actuator sleeve firmly gripping said length of control line tubing for obligating said length of control line tubing to move axially outwards if and when said actuator sleeve is moved axially outwards by rotation of said nut means in said one angular sense;

means circumferentially sealing between the exterior of said length of control line and said actuator sleeve axial bore;

means for sealingly, connectedly communicating with the radially outer end of said length of control line tubing for continuing said fluid-tight passageway outwardly beyond said penetrator;

first means normally circumferentially sealing between the exterior of said actuator sleeve and said tubular housing throughbore; and second means, brought into play as a back seat, circumferentially sealing between the exterior of said actuator sleeve and said tubular housing throughbore, only when said nut means has been rotated in said angular sense sufficiently to axially move said actuator sleeve, and thus said length of control line tubing gripped by said gripping means, so far that said inner end of said length of control line tubing is withdrawn from said mouth, and outwardly across said imaginary interface.

2. The wellhead sidewall penetrator system of claim 1, wherein:

said second circumferentially sealing means comprises: a first coaxially frusto-conical sealing surface on the exterior of said actuator sleeve and a second coaxially frusto-conical sealing surface tubular housing, in the throughbore of said tubular housing, said first and second coaxially frusto-conical sealing surfaces being in complementary facial engagement when acting as said back seat.

3. The wellhead sidewall penetrator system of claim 1 wherein:

said axial bore extends through said actuator sleeve as a throughbore thereof; and said means for sealingly, connectedly communicating with the radially outer end of said length of control line tubing for continuing said fluid-tight passageway outwardly beyond said penetrator, comprises a flanged hub on said actuator sleeve at the outer end thereof and a circumferential sealing surface on said actuator sleeve in association with said flanged hub, whereby said fluid-tight passageway may be continued by connecting a conduit to said hub and sealing said conduit with respect to this sealing surface.

4. A wellhead sidewall penetrator system for providing a disconnectable intermediate portion of a fluid-tight passageway for a communicating medium, between a down hole device within a well, and a control point externally of the well which, in use, are connected by the fluid-tight passageway, said wellhead sidewall penetrator system comprising:

said wellhead including a generally upright, tubular-sidewalled head portion having an axial throughbore with an upwardly facing seat therein, and a side outlet comprising a radial bore which intersects said throughbore intermediate the ends of said throughbore, and which emerges through the tubular sidewall intermediate the ends of said tubular sidewall; and a pipe hanger hung in the wellhead via said seat; and the fluid-tight passageway extending axially up through the hanger to an intermediate level of said hanger, then extending laterally outwards, emerging from the hanger at a mouth disposed intermediate the axial-extent of the hanger, in an exteriorly radially recessed region of said hanger, a length of control line tubing having an innter end and an outer end;

a sealing and connector means in said mouth of said fluid-tight passageway;

the inner end of said length of control line tubing normally being disposed radially inwardly beyond an imaginary interface radially between the throughbore of the tubular sidewalled-head portion and the pipe hanger by an interfacial penetration distance, and there being disposed in said mouth of said fluid-tight passageway and normally being sealed and connected in said mouth as an intermediate continuation of said fluid-tight passageway but being axially withdrawable from said mouth upon the application of an axial withdrawing force on said length of control line tubing, without there being a need for fully circumferentially rotating said length of control line tubing relative to its own longitudinal axis;

a tubular housing with a throughbore;

means sealing and securing the tubular housing to the wellhead tubular head portion at the side outlet with the throughbore of the tubular housing united with the radial bore of the side outlet;

an actuator sleeve telescopically received in the throughbore of the tubular housing;

key and keyway means provided on and engaging between said tubular housing and said actuator sleeve, for preventing the actuator sleeve from fully circumferentially rotating about the longitudinal axis thereof;

a first band of differential helical threading on said tubular housing and a second band thereof on said actuator sleeve;

actuator sleeve axial position-controlling nut means threadably engaging with both said bands of differential helical threading and normally being so engaged over a sufficient length as to cause axially outward travel of the actuator sleeve; relative to the tubular housing upon rotation of said nut means in one angular sense, by an axial amount at least as long as said interfacial penetration distance;

means providing a longitudinal bore in said actuator sleeve, opening at the radially inner end of the actuator sleeve;

said length of control line tubing extending radially outwardly relative to said wellhead tubular head portion, and axially telescopically within the axial bore of said actuator sleeve;

means on said actuator sleeve firmly gripping said length of control line tubing for obligating said length of control line tubing to more axially outwards if and when said actuator sleeve is moved axially outwards by rotation of said nut means in said one angular sense;

means circumferentially sealing between the exterior of said length of control line and said actuator sleeve axial bore;

means for sealingly, connectedly communicating the radially outer end of said length of control line tubing for continuing said fluid-tight passageway outwardly beyond said penetrator;

first means normally circumferentially sealing between the exterior of said actuator sleeve and said tubular housing throughbore; and second means, brought into play as a back seat, circumferentially sealing between the exterior of said actuator sleeve and said tubular housing throughbore, only when said nut means has been rotated in said angular sense sufficiently to axially move said actuator sleeve, and thus said length of control line tubing gripped by said gripping means, so far that said inner end of said length of control line tubing is withdrawn from said mouth, and outwardly across said imaginary interface.

5. The wellhead sidewall penetrator system of claim 4, wherein:

said second circumferentially sealing means comprises: a first coaxially frusto-conical sealing surface on the exterior of said actuator sleeve and a second coaxially frusto-conical sealing surface tubular housing, in the throughbore of said tubular housing, said first and second coaxially frusto-conical sealing surfaces being in complementary facial engagement when acting as said back seat.

6. The wellhead sidewall penetrator system of claim 4, wherein:

said axial bore extends through said actuator sleeve as a throughbore thereof; and said means for sealingly, connectedly communicating with the radially outer end of said length of control line tubing for continuing said fluid-tight passageway outwardly beyond said penetrator, comprises a flanged hub on said actuator sleeve at the outer end thereof and a circumferential sealing surface on said actuator sleeve in association with said flanged hub, whereby said fluid-tight passageway may be continued by connecting a conduit to said hub and sealing said conduit with respect to this sealing surface.

7. Apparatus for connecting a laterally outwardly opening control fluid passageway in a well pipe hanger with a side outlet passageway in a well pipe head in the vertical bore of which the well pipe hanger is suspended, with provision being made for withdrawing the connection radially outwards across the surface between the hanger and the head, said apparatus comprising:

first constrictable frictionally gripping means mounted in the control fluid passageway;

a length of flexible tubing having an inner end portion inserted in said control fluid passageway, said tubing length inner end portion being frictionally gripped and held in sealed relation therein by constriction thereabout of said first constrictable frictionally gripping means;

a tubular sleeve telescopically non-rotatively slidably received in said side outlet passageway with annular sealing means being provided between said tubular sleeve and said side outlet passageway, said tubular sleeve having a longitudinal bore;

said tubing length having an outer end portion inserted in said tubular sleeve longitudinal bore, said tubing length outer end portion being frictionally gripped and held in sealed relation therein by constriction thereabout of said second constrictable frictionally gripping means;

said second constrictable frictionally gripping means further including stop means for preventing axial withdrawal of said tubing length outer end portion therethrough;

a tubular nut having differential internal and external threading thereon, said tubular nut being coaxially received radially between said side outlet passageway and said tubular sleeve and in threaded engagement with both, said tubular nut having a wrenching land means accessable for wrenched rotation from externally of said head;

whereby:

(a) a sealed connection may be made across said interface even when the control fluid passageway is misaligned with respect to the side outlet passageway, due to the flexibility of said tubing length, (b) said tubing length need not be precut to an exact length, due to the flexibility thereof and due to the possibility of permitting more or less of at least one said end portion thereof to project past the respective constrictable frictionally gripping means to accommodate field conditions; and (c) said tubing length may be non-rotatively withdrawn radially outwards of said head across said interface by wrenching upon said tubular nut.

* * * * *